US007448340B1

(12) United States Patent
Gibson

(10) Patent No.: US 7,448,340 B1
(45) Date of Patent: Nov. 11, 2008

(54) DIVING DEVICE

(76) Inventor: Edward Gibson, 555 9th St., Lakeport, CA (US) 95453

( * ) Notice: Subject to any disclaimer, the term of this patent is extended or adjusted under 35 U.S.C. 154(b) by 191 days.

(21) Appl. No.: 11/007,966

(22) Filed: Dec. 9, 2004

Related U.S. Application Data

(60) Provisional application No. 60/532,315, filed on Dec. 22, 2003.

(51) Int. Cl.
*B63C 11/46* (2006.01)

(52) U.S. Cl. ..... 114/315

(58) Field of Classification Search ..... 114/315; 405/186

See application file for complete search history.

(56) References Cited

U.S. PATENT DOCUMENTS 3,131,664 A * 5/1964 McInvale ..... 114/315
3,329,118 A * 7/1967 Strader ..... 114/315
4,009,583 A 3/1977 Buckle
4,065,874 A 1/1978 Ross
4,179,841 A 12/1979 Kupperman et al.
4,274,223 A 6/1981 Morrison et al.
5,469,803 A 11/1995 Gallo
6,371,041 B1 4/2002 Ness
6,443,799 B1 9/2002 Gibson
6,461,204 B1 10/2002 Takura et al.

* cited by examiner

*Primary Examiner*—Ed Swinehart

(57) ABSTRACT

The diving device is comprised of a hollow hull with a side profile which is rounded at the front and tapered at the back for low resistance in water. The hull includes side wings on opposite sides of a bulbous body. Handles are arranged in the wings. The buoyancy of the diving device is adjusted by letting in or draining water through a valve at the back of the hull. Fill level marks on the hull show how much water is inside the hull, which is preferably transparent to show the fill level. The buoyancy provides resistance during descend and assistance during ascend. A sealed, air-filled shell is positioned inside hull to provide a minimum amount of buoyancy even if the hull is completely filled. A valve at the front of the hull may be opened during ascend to release bubbles for amusement.

4 Claims, 2 Drawing Sheets

DIVING DEVICE

CROSS REFERENCE TO RELATED APPLICATION

I claim the priority of provisional patent application 60/532,315 filed on Dec. 22, 2003.

BACKGROUND OF THE INVENTION

1. Field of the Invention

The invention broadly relates to water toys.

2. Prior Art

An experienced diver diving down unassisted is relatively easy, and ascending is also easy and unexciting. Therefore, underwater propulsion devices have been invented for propelling the diver for more excitement. Such devices are disclosed in U.S. Pat. Nos. 5,469,803 to Gallo and 6,461,204 to Takura et al. However, such devices further reduce the physical exertion required to dive. Also, they are motorized so that they are complicated, and must be relatively large to house a large enough motor and batteries to provide practical thrust.

BRIEF SUMMARY OF THE INVENTION

An object of the present diving device is to resist diving for a greater workout.

Another object is to provide high lift during ascend for a faster and more exciting rise to the surface.

Yet another object is to be adjustable in dive resistance and ascend assistance.

Still another object is to be very simple.

The diving device is comprised of a hollow hull with a side profile which is rounded at the front and tapered at the back for low resistance in water. The hull includes side wings on opposite sides of a bulbous body. Handles are arranged in the wings. The buoyancy of the diving device is adjusted by letting in or draining water through a valve at the back of the hull. Fill level marks on the hull show how much water is inside the hull, which is preferably transparent to show the fill level. The buoyancy provides resistance during descend and assistance during ascend. A sealed, air-filled shell is positioned inside hull to provide a minimum amount of buoyancy even if the hull is completely filled. A valve at the front of the hull may be opened during ascend to release bubbles for amusement.

DRAWING REFERENCE NUMERALS

| | |
|---|---|
| 10. Diving Device | 11. Hull |
| 12. Handle | 13. Bulbous Body |
| 14. Front | 15. Back |
| 16. Side Wing | 17. Valve |
| 18. Valve | 19. Fill Level Mark |
| 20. Air-Fill Shell | |

DETAILED DESCRIPTION OF THE INVENTION

Figure 1:
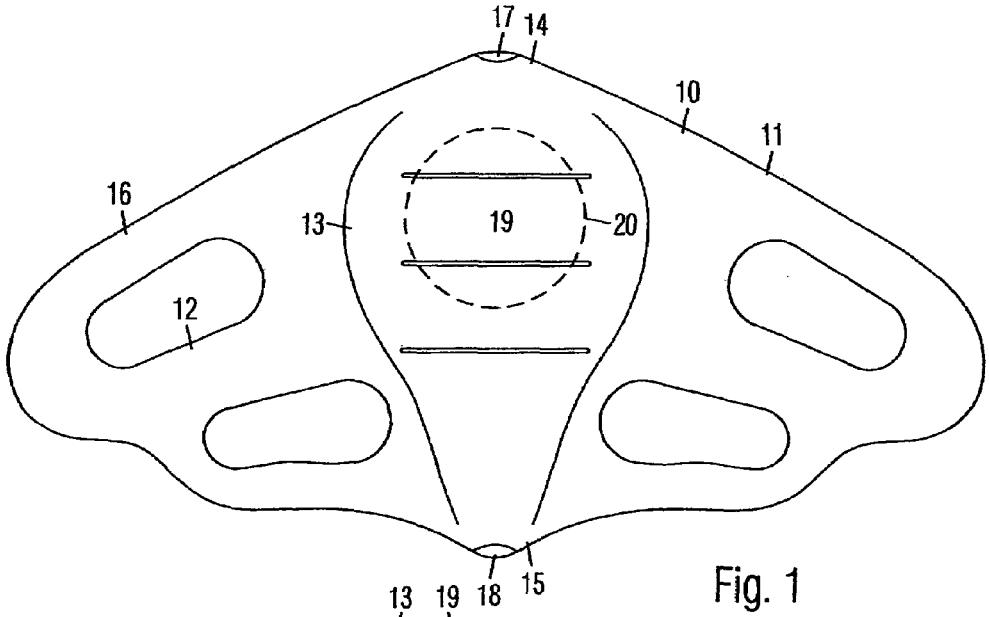
FIG. 1 a top view of the diving device.
Figure 2:
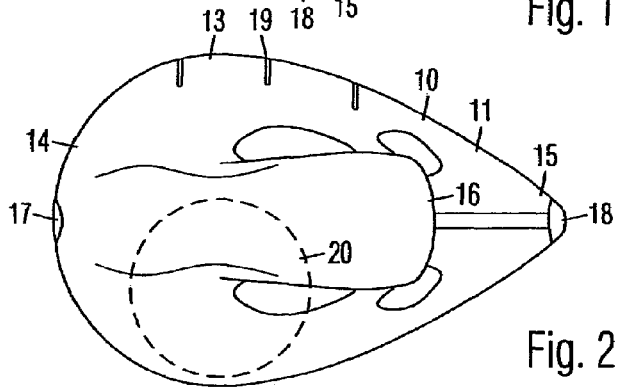
FIG. 2 is a side view thereof.
Figure 3:
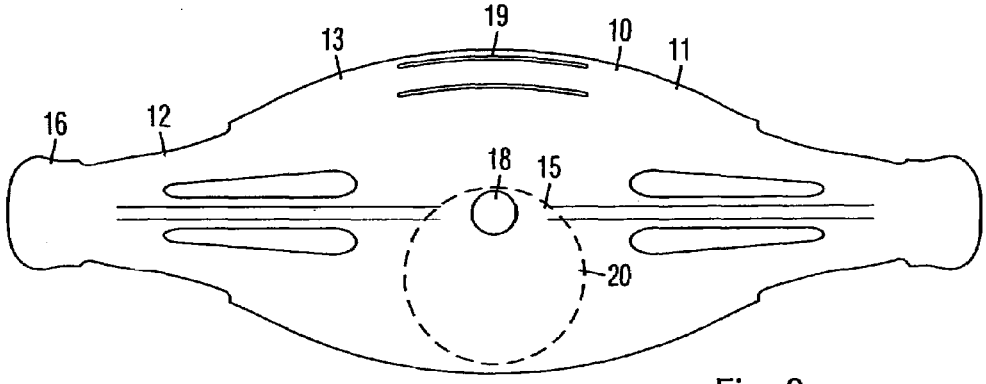
FIG. 3 is a rear view thereof.

FIGS. 1-3:

A preferred embodiment of a diving device 10 shown in FIG. 1 is comprised of a hollow plastic hull 11 with handles 12. Hull 11 is preferably comprised of a bulbous body 13 which, when seen in a side view in FIG. 2, is rounded at a front 14 and tapered at a back 15 for low resistance in water. Hull 11 preferably includes side wings 16 on opposite sides of bulbous body 13. Handles 12 are positioned along rear edges of side wings 16.

A valve 17 is provided at front 14 of hull 11, and a valve 18 is provided at back 15 of hull 11 for letting in or draining water. Valves 17 and 18 may be any type of device which allows water to enter and exit hull 11, such as a plug or cap on a hole.

Fill level marks 19 on hull 11 show how much water is inside hull 11, which is preferably translucent to show the fill level. A sealed, air-filled plastic shell 20 is positioned inside hull 11.

Figure 4:
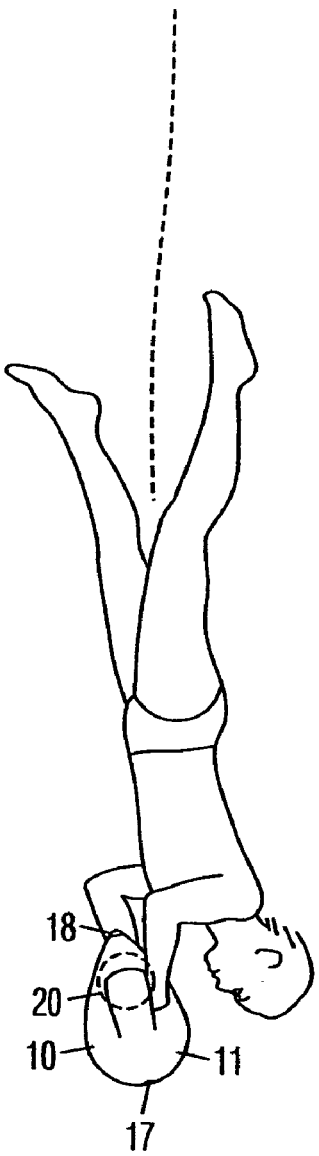
FIG. 4 shows the diving device during descend.
Figure 5:
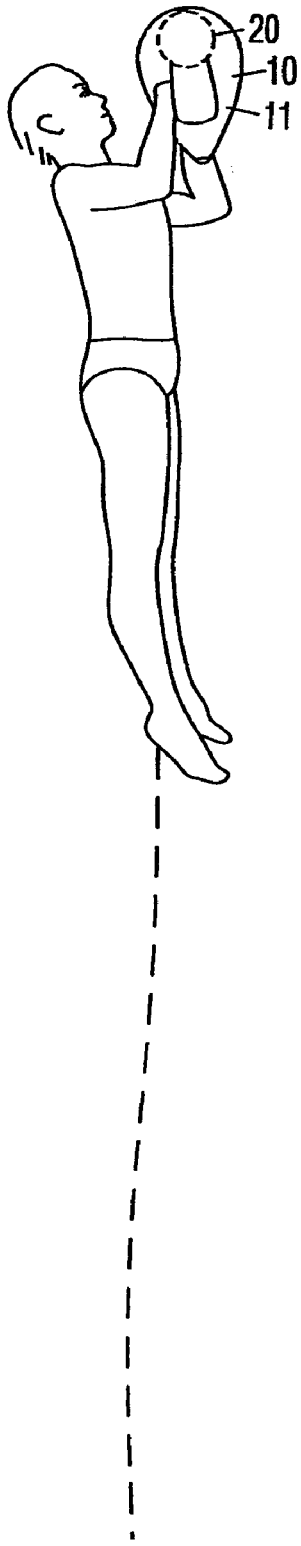
FIG. 5 shows the diving device during ascend.

FIGS. 4-5:

Diving device 10 has a buoyancy which is adjustable by filling hull 11 through valve 18 with water to different levels and leaving different amounts of air inside. Valve 18 is closed after filling. The buoyancy provides resistance during descend and assistance during ascend. A stronger swimmer may fill hull 11 with less water and leave more air inside to provide strong resistance during descend for a better workout as shown in FIG. 4, and to provide high lift during ascend for a faster and more exciting rise to the surface as shown in FIG. 5. A weaker swimmer may fill hull 11 with more water and leave less air inside for less resistance during descend and a slower assisted ascend. Air-filled shell 20 ensures a minimum level of buoyancy even if hull 11 is completely filled with water. Valve 17 may be opened during ascent to release air bubbles for amusement.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A diving device comprising:

A hollow hull having a volume, said hull including a central bulbous body which is rounded in the front and tapered at the rear for low resistance, a pair of side wings on opposite sides of the bulbous body, each wing providing a handle for a user, at least a first opening in the hull including a valve for allowing water to enter the hull to adjust the buoyancy thereof, a sealed, air filled shell inside the hull to provide a minimum amount of buoyancy even when the hull is filled with water.

2. The diving device of claim 1, said handles provided on respective rear edges of the side wings.

3. The diving device of claim 1, further including a second opening at the front of the hull which is openable during ascent to release bubbles for amusement.

4. The diving device of claim 1, further including fill level marks on the hull for showing the water level inside the hull.

* * * * *